United States Patent [19]

Schaefer

[11] Patent Number: 4,849,165

[45] Date of Patent: Jul. 18, 1989

[54] METAL TREATMENT AGENTS

[75] Inventor: Fritz Schaefer, Borken, Fed. Rep. of Germany

[73] Assignee: Foseco International Limited, Birmingham, England

[21] Appl. No.: 191,535

[22] Filed: May 9, 1988

[30] Foreign Application Priority Data

May 22, 1987 [GB] United Kingdom ..... 8712168

[51] Int. Cl.[4] ..... C21C 7/02

[52] U.S. Cl. ..... 420/23; 75/53; 75/58

[58] Field of Search ..... 75/58, 53, 0.5 B; 420/23

[56] References Cited

U.S. PATENT DOCUMENTS

| | | | |
|---|---|---|---|
| 3,321,304 | 5/1967 | Snow | 420/129 |
| 3,921,700 | 11/1975 | Frantzreb et al. | 164/57 |
| 3,957,502 | 5/1976 | Cull | 75/58 |
| 4,076,522 | 2/1978 | Yoshida | 75/58 |
| 4,186,000 | 1/1980 | Skach, Jr. et al. | 75/0.5 B |
| 4,279,643 | 7/1981 | Jackman | 75/58 |
| 4,541,867 | 9/1985 | Neelameggham et al. | 75/58 |
| 4,553,572 | 8/1985 | Neelameggham et al. | 75/58 |

FOREIGN PATENT DOCUMENTS

| | | |
|---|---|---|
| 829802 | 1/1952 | Fed. Rep. of Germany . |
| 1328995 | 9/1973 | United Kingdom . |
| 1379654 | 1/1975 | United Kingdom . |
| 1414624 | 11/1975 | United Kingdom . |
| 1415150 | 11/1975 | United Kingdom . |
| 1549982 | 8/1979 | United Kingdom . |
| 1564921 | 4/1980 | United Kingdom . |
| 2030920A | 4/1980 | United Kingdom . |

OTHER PUBLICATIONS

Patent Abstracts of Japan, vol. 1, No. 102(C-25<), [2288], Sep. 10, 1977, pp. 2288 C 77 & JP-A-52 63 811, (UBE Kosan KK) 26-05-1977.

*Primary Examiner*—Peter D. Rosenberg
*Attorney, Agent, or Firm*—Nixon & Vanderhye

[57] ABSTRACT

Metallurgical treatment agents for molten ferrous metals e.g. iron and steel and suitable for e.g. desulphurizing molten iron and steel comprise particulate magnesium coated with a first coating of a hydrophobic compound and a second coating of a particulate refractory material. The coated magnesium possesses improved flowability and is less prone to premature reaction when subjected to a high temperatures. The hydrophobic compound provides the magnesium with enhanced protection against hydration than may be obtained by a refractory coating alone.

17 Claims, No Drawings

METAL TREATMENT AGENTS

This invention relates to metallurgical treatment agents for molten metals particularly for the desulphurisation of ferrous metals and their method of production.

In addition to desulphurisation of ferrous metals other effects may be obtained such as deoxidation, inclusion shape modification and nodularisation.

It has been proposed to desulphurise molten ferrous metals such as iron and steel by use of treatment agents containing magnesium. More recently it has been proposed to treat molten iron with magnesium by injecting the metal beneath the surface of the iron and satisfactory results have been obtained although problems with material flow and lance blockage have sometimes been encountered.

Although magnesium has gained acceptance as a useful treatment agent it possesses disadvantages which create problems during its production and/or use. A particular disadvantage of magnesium relates to its high vapour pressure at molten metal temperatures and the violence with which it reacts on contact with molten ferrous metals.

There are many suggestions in patent literature in respect of means to control the reaction of magnesium with molten ferrous metals. However, only a relatively few of these proposals have gained any significant measure of commercial success. Notably, there is a treatment agent described in U.S. Pat. No. 3,321,304 of American Cast Iron Pipe Company comprising porous metallurgical coke impregnated with magnesium and there is a treatment agent described in U.S. Pat. No. 4,186,000 of The Dow Chemical Company comprising salt-coated magnesium granules. The salt coating comprises predominately an admixture of alkali metal halides and alkaline earth metal halides, particularly chlorides. The latter proved to be a significant advance because the salt-coated magnesium could be injected on its own i.e. without any filler material such as lime or ball-mill-dust, without excessive violence and without the high risk of lance blockage when injecting uncoated magnesium particles. Due to the high thermal conductivity and low melting point of magnesium, adherence of magnesium in the vicinity of the exit of an injection lance can occur when injecting uncoated magnesium and this can contribute to lance blockage. Nevertheless, the salt-coated magnesium product suffers from the disadvantage of environmental pollution emanating from the metal halide coating material which may give rise to e.g. hazardous chlorine fumes polluting the work place. In addition such products are hygroscopic and tend to agglomerate during storage. Particulate magnesium having an adherent coating of refractory material having a very small particle size is known. By using a refractory material having a very small particle size a tenacious refractory coating can be produced on the particulate magnesium without the need for a binder.

The coating improves the smooth flow of the coated granules and most effectively protects the magnesium against premature reaction when subjected to high temperatures. However, such coated magnesium suffers the disadvantage of generating non-adherent fine particles from the outer coating when the product is e.g. pneumatically conveyed in a steelworks for distances in excess of about 75 meters leading to blockages in the material transport system.

It has now been found that an improved coated magnesium treatment agent of the type described herein can be produced if the particulate magnesium is first coated with a hydrophobic compound.

According to the present invention there is provided a treatment agent for molten ferrous metals comprising particulate magnesium coated with a first coating of a hydrophobic compound and a second coating of particulate refractory material.

Preferably the hydrophobic compound is a liquid.

Suitable hydrophobic liquids for coating the magnesium particles include aliphatic or aromatic oils, for example oils derived from petroleum or from coal or silicone oils. Paraffin based oils of low or medium grade generally used as compressor oils, as bearing oils or for machine lubrication are particularly satisfactory. In order that the hydrophobic liquid may be readily coated onto the magnesium particles the hydrophobic liquid preferaly is of relatively low viscosity i.e. within a range from about 20 to about 40 centipoise at 25° C.

The hydrophobic compound of the present invention may itself comprise a mixture of compounds e.g. an oil which contains several different molecular weight compounds. Furthermore, the hydrophobic compound may be a material which is solid at ambient temperature but which may be rendered liquid at relatively low temperatures such as, for example, a low-melting wax e.g. a paraffin wax.

The quantity of compound needed to coat the particulate magnesium is relatively small and usually about 1% by weight based on the weight of particulate magnesium will be sufficient.

The refractory material of the coating may be selected from one or more of alumina, magnesia, silica, titania, lime (CaO), dolomite, calcium carbonate, calcium aluminate, other refractory aluminates, refractory silicates or alumino-silicates. The refractory coating may comprise up to about 40% of the particulate treatment agent but more preferably is within the range of from about 8 to 25%.

Preferably the particle size of the magnesium particles does not exceed 1 mm.

The coated magnesium treatment may be produced by e.g. mixing the particulate magnesium thoroughly with the compound for example in a drum-type mixer and then adding the particles of refractory material and continuing the mixing process until the particles of refractory material are thoroughly dispersed and coated onto the compound magnesium particles.

The coating of refractory material may itself consist of a first and second coating, the nature of which may be the same or different. In a preferred embodiment the refractory coating consists of a first inner coating of ultra-fine alumina or silica and a second outer coating of fine alumina. Preferably the amount of the inner coating provides 1 to 4% of the weight of the refractory coated magnesium particles and preferably the outer coating provides 4 to 39% of the weight of the refractory coated magnesium particles.

The weight average particle size of the refractory material forming a single layer coating or the inner layer of a duplex coating is preferably less than 5 microns, more preferably less than 3 microns and most preferably less than 1 micron. When a duplex coating is used the weight average particle size of the refractory material forming the outer layer may be larger for example up to about 20 microns.

The weight average particle size of the refractory material may be determined using sedigraph testing equipment which apparatus is known for measuring the size of very fine particles, too fine for accurate determination using conventional sieve grading. A sedigraph determines the relative rate of rise of particulate matter suspended in a liquid medium.

The hydrophobic compound produces a surface film on the magnesium particles thus providing additional protection against hydration compared to the protection achieved by a refractory coating alone, and allowing stringent packaging regulations (normally steel drums or nitrogen sealed containers are used) to be dispensed with and giving easier bulk transportation of the treatment agent.

The hydrophobic compound coating also enables the application of the coating of particles of refractory material to be carried out more efficiently by reducing the amount of wastage of particles of refractory material which do not become coated onto the magnesium particles.

In addition the use of the hydrophobic compound permits the use of coarser particulate refractory material than is the case when the hydrophobic compound coating is omitted.

The treatment agent of the invention in particulate form is suitable for injection into molten ferrous metals such as iron or steel in a carrier gas such as argon, nitrogen, air, methane or propane. The preferred carrier gas is argon. If desired the treatment agent may be administered at the same time as other treatment agents such as lime, ball-mill-dust, alumina, calcium aluminate, calcium carbonate or sodium carbonate, conveniently as a mixture with the treatment agents all injected together.

The treatment agent may be in the form of the particles contained within an elongate metal casing e.g. in the form of a wire-like product. The wire may be injected into iron in the production of S.G. iron.

According to a further aspect of the present invention there is provided a method of treating a molten ferrous metal which comprises treating the metal with a treatment agent according to the invention.

The following Examples will serve to illustrate the invention:

EXAMPLE 1

A coated particulate magnesium treatment agent was produced in the laboratory having the following composition by weight:

| | % |
|---|---|
| Magnesium | 87 |
| Paraffin-based oil (trade name AVILUB RS) | 1 |
| Silica | 2 |
| Alumina | 10 |

The magnesium had a weight average particle size of 0.3 mm, the silica had a weight average particle size of 0.28 microns and the alumina had a weight average particle size of 10 microns, as measured using a sedigraph.

The oil and the particulate magnesium were mixed together in a drum mixer for 3 minutes, the silica was added and mixing continued for 4 minutes, and finally the alumina was added and mixing continued for a further 3 minutes.

The coated magnesium particles were separated from the fine particles of alumina which had not become coated and the quantity of non-adherent fines was determined as 0.5% by weight. By comparison production of a similar treatment agent having no coating of paraffin oil by the same method resulted in non-adherent fines of 6% by weight.

The degree of protection against hydration afforded to the magnesium particles having an oil coating and the duplex silica and alumina coating was assessed by immersing the coated particles in water and measuring the rate of evolution of hydrogen gas. The rate of evolution was determined as 0.08 l/kg.hr. In a similar test on uncoated magnesium particles the rate of gas evolution was 0.12 l/kg.hr.

In Table 1 the results are shown for the use of the treatment agent of Example 1 as a desulphurising agent injected into approximately 300 tonnes of molten iron having an initial temperature of 1400° C.

TABLE 1

| Treatment No. | Quantity of Iron (tonnes) | Initial Sulphur (%) | Final Sulphur (%) | Kg/tonne Magnesium | Natural log Initial S / Final S |
|---|---|---|---|---|---|
| 1 | 336 | 0.041 | 0.002 | 1.05 | 3.02 |
| 2 | 349 | 0.043 | 0.002 | 1.02 | 3.07 |
| 3 | 352 | 0.045 | 0.002 | 1.02 | 3.11 |
| 4 | 328 | 0.045 | 0.002 | 1.09 | 3.11 |
| 5 | 357 | 0.041 | 0.002 | 1.16 | 3.02 |
| 6 | 330 | 0.037 | 0.002 | 1.09 | 2.92 |
| 7 | 311 | 0.038 | 0.002 | 1.16 | 2.94 |
| 8 | 359 | 0.043 | 0.003 | 0.90 | 2.66 |
| 9 | 350 | 0.043 | 0.003 | 0.93 | 2.66 |
| 10 | 351 | 0.043 | 0.003 | 0.92 | 2.66 |

The results in Table 1 illustrates that a treatment agent according to the invention enables ultra-low levels of sulphur to be achieved for a given quantity of magnesium used. Furthermore, the results indicate that there is little segregation of the agent prior to its addition to the molten metal which may be determined by the absence of any abnormally high or low concentration of magnesium. This is particularly beneficial when compared with treatment agents comprising a mixture of magnesium with other additives or materials which exhibit severe segregation.

EXAMPLE 2

A further six injectable desulphurisation agents for molten iron were each prepared by the procedure in Example 1 except that in the case of three of the agents the oil coating was omitted.

The quantity of non-adherent fines was determined for each of the six agents as indicated in Table 2.

TABLE 2

| Test No. | Composition of Outer Coating | Wt. Average Particle Size of Outer Coating | % Fines without an Oil Coating | % Fines with 1% Oil Coating |
|---|---|---|---|---|
| 1 A | 2% Silica 20% Alumina | 3.76 microns | 1.54% | N/A |
| 2 A | 2% silica 20% Alumina | 3.76 microns | N/A | 0.36% |
| 1 B | 20% Calcium Aluminate | 13 microns | 20% | N/A |
| 2 B | 20% Calcium Aluminate | 13 microns | N/A | 0.3% |
| 1 C | 2% Silica 20% Alumina | 3.5 microns | 1.12% | N/A |
| 2 C | 2% Silica | 3.5 microns | N/A | 0.66% |

TABLE 2-continued

| Test No. | Composition of Outer Coating | Wt. Average Particle Size of Outer Coating | % Fines without an Oil Coating | % Fines with 1% Oil Coating |
|---|---|---|---|---|
| | 20% Alumina | | | |

In Tests A and C the silica had a weight average particle size of 0.28 microns and was applied to the magnesium or the magnesium coated with oil, prior to the alumina of the outer coating as appropriate.

The results in Table 2 indicate the significant improvement obtained in respect of the quantity of non-adherent fines produced when an hydrophobic compound is used. Furthermore, the results of Test B clearly show the very considerable improvement obtained for a relatively coarse material such as calcium aluminate having a weight average particle size of 13 microns. In this case without the use of the hydrophobic compound none of the material remained on the magnesium at the end of the test.

I claim:

1. A treatment agent for molten ferrous metals comprising particulate magnesium having a first coating consisting essentially of a hydrophobic compound and a second coating of particulate refractory material on said first coating, said particulate refractory material having a weight average particle size of less than 5 microns.

2. A treatment agent according to claim 1 wherein the hydrophobic compound is a liquid.

3. A treatment agent according to claim 1 wherein the hydrophobic compound is an oil.

4. A treatment according to claim 3 wherein the oil is selected from one or more of aliphatic, aromatic and silicone oils.

5. A treatment agent according to claim 3 wherein the oil is a low or medium grade paraffin oil.

6. A treatment agent according to claim 2 wherein the viscosity of the hydrophobic liquid is within the range from 20 to 40 centipoise at 25° C.

7. A treatment agent according to claim 1 wherein the hydrophobic compound is a low-melting wax.

8. A treatment agent according to claim 7 wherein the low-melting wax is a paraffin wax.

9. A treatment agent according to claim 1 wherein the refractory material of the second coating is selected from the group consisting of alumina, magnesia, silica, titania, lime, dolomite, calcium carbonate, calcium aluminate, refractory aluminates, refractory silicates and alumino-silicates.

10. A treatment agent according to claim 9 wherein the refractory coating comprises up to about 40% of the particulate treatment agent.

11. A treatment agent according to claim 1 wherein the particle size of the magnesium does not exceed 1 mm.

12. A treatment agent according to claim 1 wherein the refractory coating itself comprises an inner layer and an outer layer.

13. A treatment agent according to claim 1 wherein the treatment agent is contained within an elongate metal casing.

14. A method of forming a treatment agent according to claim 1 which comprises mixing particulate magnesium together with the hydrophobic compound in a mixer until the magnesium is thoroughly coated to provide a first coating, adding the particulate refractory material and continuing mixing until the particles of refractory material are thoroughly dispersed to provide a second coating on the first coating.

15. A treatment agent according to claim 1 wherein said weight average particle size is less than 3 microns.

16. A treatment agent according to claim 1 wherein said weight average particle size is less than 1 micron.

17. A treatment agent according to claim 12 wherein said outer layer of refractory material has a weight average particle size of up to about 20 microns.

* * * * *